US010813514B2

(12) United States Patent
Jang et al.

(10) Patent No.: US 10,813,514 B2
(45) Date of Patent: Oct. 27, 2020

(54) ROBOT CLEANER

(71) Applicant: LG ELECTRONICS INC., Seoul (KR)

(72) Inventors: Jaewon Jang, Seoul (KR); Jeongyun Kim, Seoul (KR); Donghoon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 241 days.

(21) Appl. No.: 15/569,598

(22) PCT Filed: Sep. 21, 2016

(86) PCT No.: PCT/KR2016/010513
§ 371 (c)(1),
(2) Date: Oct. 26, 2017

(87) PCT Pub. No.: WO2017/052180
PCT Pub. Date: Mar. 30, 2017

(65) Prior Publication Data

US 2018/0296053 A1 Oct. 18, 2018

(30) Foreign Application Priority Data

Sep. 23, 2015 (KR) ..... 10-2015-0134513

(51) Int. Cl.
*A47L 11/292* (2006.01)
*A47L 11/40* (2006.01)

(52) U.S. Cl.
CPC ..... *A47L 11/292* (2013.01); *A47L 11/4011* (2013.01); *A47L 11/4016* (2013.01);
(Continued)

(58) Field of Classification Search
CPC ..... A47L 11/292; A47L 11/4011; A47L 11/4016; A47L 11/4041; A47L 11/4044;
(Continued)

(56) References Cited

U.S. PATENT DOCUMENTS 1,464,031 A * 8/1923 Daly ..... A47L 11/292 15/50.3
1,520,769 A * 12/1924 Peterson ..... A47L 11/292 15/52

(Continued)

FOREIGN PATENT DOCUMENTS

DE 10-2013-108905 2/2015
EP 2 747 626 7/2014

(Continued)

OTHER PUBLICATIONS

Kim, Kwang Hyun; "Cleaning Apparatus Using Water" Apr. 2008, KR 10-0822785—Machine Translation (Year: 2008).*
Shin, Jung Young et al.; "Robot Cleaning with Wet Towel and a Power Charger with Automatic Washer". Jun. 2010, KR 100962121—Machine Translation (Year: 2010).*

(Continued)

*Primary Examiner* — David G Cormier
*Assistant Examiner* — Thomas Bucci
(74) *Attorney, Agent, or Firm* — Ked & Associates, LLP

(57) ABSTRACT

Disclosed is a cleaner comprising a cleaner body, a front wheel rotatably provided in a front portion of the cleaner body, a rear wheel rotatably provided in a rear portion of the cleaner body, a first member attached to an outer circumferential surface of the front wheel and configured to contact with a cleaning object surface, a second member attached to an outer circumferential surface of the rear wheel and configured to contact with the cleaning object surface, a front motor rotating the front wheel, a rear motor rotating the rear wheel and a controller driving the front motor and the rear motor, wherein the controller controls the front motor (Continued)

and the rear motor to become rotated in the opposite directions while cleaning is performed.

15 Claims, 5 Drawing Sheets

(52) U.S. Cl.
CPC ..... *A47L 11/4041* (2013.01); *A47L 11/4044* (2013.01); *A47L 11/4066* (2013.01); *A47L 11/4072* (2013.01); *A47L 11/4083* (2013.01); *A47L 11/4088* (2013.01); *A47L 2201/00* (2013.01); *A47L 2201/06* (2013.01)

(58) Field of Classification Search
CPC ..... A47L 11/4083; A47L 11/4088; A47L 2201/06
USPC ... 134/60.21, 18, 117, 184, 198, 56 R, 58 R; 15/319, 320, 98, 50.3, 52, 383, 50.1, 15/340.1, 322, 52.1, 401, 179
See application file for complete search history.

(56) References Cited

U.S. PATENT DOCUMENTS 1,597,644 A * 8/1926 Wiener ..... A47L 11/185 15/50.3
1,619,313 A * 3/1927 Prince ..... A47L 11/292 15/51
2,642,601 A * 6/1953 Saffioti ..... A47L 11/4088 15/98
2,969,556 A * 1/1961 Name Not Available ..... A47L 11/4077 15/52.1
3,789,449 A * 2/1974 MacFarland ..... A47L 11/292 15/4
4,654,916 A * 4/1987 Postonen ..... A47L 11/292 15/1.7
4,845,794 A * 7/1989 Korski ..... A47L 11/4041 15/51
5,287,581 A * 2/1994 Lo ..... A47L 11/292 15/230
5,636,402 A * 6/1997 Kubo ..... A47L 11/03 15/319
5,657,504 A * 8/1997 Khoury ..... A47L 11/03 15/103.5
5,735,959 A * 4/1998 Kubo ..... A47L 11/03 118/244
5,815,880 A * 10/1998 Nakanishi ..... A47L 11/20 15/319
6,463,616 B1 * 10/2002 Morokutti ..... A47L 11/03 15/48
6,735,812 B2 * 5/2004 Hekman ..... A47L 11/292 134/21
6,883,201 B2 * 4/2005 Jones ..... A47L 5/30 15/319
7,620,476 B2 * 11/2009 Morse ..... A47L 5/14 15/319
8,382,906 B2 * 2/2013 Konandreas ..... A22C 17/0013 134/21
8,392,021 B2 * 3/2013 Konandreas ..... A22C 17/0013 318/568.1
8,438,695 B2 * 5/2013 Gilbert, Jr. ..... A47L 11/302 15/319
8,985,127 B2 * 3/2015 Konandreas ..... A22C 17/0013 134/184
2002/0174506 A1 * 11/2002 Wallach ..... G05D 1/0291 15/319
2002/0194692 A1 * 12/2002 Giddings ..... A47L 11/4044 15/320
2004/0172769 A1 * 9/2004 Giddings ..... A47L 11/185 8/148
2005/0015913 A1 * 1/2005 Kim ..... G05D 1/0246 15/319
2005/0166354 A1 * 8/2005 Uehigashi ..... A47L 9/2852 15/319
2006/0184293 A1 * 8/2006 Konandreas ..... A47L 11/4011 701/23
2006/0185690 A1 * 8/2006 Song ..... A47L 11/34 134/21
2006/0190132 A1 * 8/2006 Morse ..... A47L 11/4041 700/245
2006/0190133 A1 * 8/2006 Konandreas ..... A47L 11/4088 700/245
2006/0200281 A1 * 9/2006 Ziegler ..... A47L 11/34 701/23
2007/0016328 A1 * 1/2007 Ziegler ..... A47L 7/0042 700/245
2007/0044258 A1 * 3/2007 Damrath ..... A47L 13/60 15/98
2007/0061040 A1 * 3/2007 Augenbraun ..... A47L 5/225 700/245
2008/0127445 A1 * 6/2008 Konandreas ..... A47L 11/4011 15/319
2008/0276407 A1 * 11/2008 Schnittman ..... A47L 11/34 15/319
2008/0282494 A1 * 11/2008 Won ..... A47L 11/24 15/319
2009/0271940 A1 * 11/2009 Lee ..... A47L 11/34 15/319
2009/0314318 A1 * 12/2009 Chang ..... A47L 11/40 134/58 R
2010/0125968 A1 * 5/2010 Ho ..... A47L 9/106 15/319
2011/0232013 A1 * 9/2011 Sappenfield ..... A47L 11/4069 15/103.5
2012/0167917 A1 * 7/2012 Gilbert, Jr. ..... A47L 11/408 134/6
2012/0189507 A1 * 7/2012 Ko ..... F24F 6/00 422/291
2013/0025077 A1 * 1/2013 De Wit ..... A46D 1/00 15/21.1
2013/0118524 A1 * 5/2013 Konandreas ..... A47L 11/4044 134/6
2013/0145572 A1 * 6/2013 Schregardus ..... A47L 11/4011 15/319
2013/0145577 A1 * 6/2013 Davidshofer ..... A47L 9/02 15/383
2013/0305483 A1 * 11/2013 Dyson ..... A47L 9/1616 15/353
2013/0305484 A1 * 11/2013 Dyson ..... A47L 9/1625 15/353
2014/0026339 A1 * 1/2014 Konandreas ..... A47L 7/0028 15/50.1
2014/0130289 A1 * 5/2014 Hyun ..... A47L 11/4083 15/319
2014/0130294 A1 * 5/2014 Li ..... A47L 9/0488 15/372
2014/0145495 A1 * 5/2014 Shin ..... B25J 5/007 301/6.5
2014/0182079 A1 7/2014 Van Der Kooi et al.
2014/0182627 A1 * 7/2014 Williams ..... A47L 11/4044 134/21
2014/0189978 A1 * 7/2014 Van Der Kooi .... A47L 11/4041 15/364
2014/0208527 A1 * 7/2014 Lin ..... A47L 11/4088 15/4
2014/0209122 A1 * 7/2014 Jung ..... A47L 11/4088 134/18
2014/0215749 A1 * 8/2014 Van Der Kooi ..... A47L 9/0477 15/322
2015/0082579 A1 * 3/2015 Lin ..... A47L 11/4088 15/320
2015/0297047 A1 * 10/2015 Van Der Kooi ..... A47L 9/0488 15/364
2015/0320279 A1 * 11/2015 Ebrahinni Afrouzi ..... A47L 9/0411 134/6

(56) References Cited

U.S. PATENT DOCUMENTS

| | | | | |
|---|---|---|---|---|
| 2016/0051108 | A1* | 2/2016 | Huang | A47L 9/0488 15/347 |
| 2016/0095487 | A1* | 4/2016 | Koura | A47L 9/1418 15/383 |
| 2016/0106286 | A1* | 4/2016 | Gardner | A47L 11/4041 15/320 |
| 2018/0344112 | A1* | 12/2018 | Krebs | A47L 11/292 |

FOREIGN PATENT DOCUMENTS

| | | | |
|---|---|---|---|
| JP | 2014-045898 | | 3/2014 |
| KR | 10-0652260 | | 11/2006 |
| KR | 10-0822785 | | 4/2008 |
| KR | 100822785 | B1 * | 4/2008 |
| KR | 10-0962121 | | 6/2010 |
| KR | 100962121 | B1 * | 6/2010 |
| KR | 10-2011-0026414 | | 3/2011 |
| KR | 10-2014-0098619 | | 8/2014 |
| KR | 10-2015-0106266 | | 9/2015 |

OTHER PUBLICATIONS

International Search Report and Written Opinion dated Jan. 23, 2017 issued in Application No. PCT/KR2016/010513.
European Search Report dated Nov. 21, 2018 issued in Application No. 16848906.0.
Korean Office Action dated Aug. 27, 2020 issued in KR Application No. 10-2016-0175631.

* cited by examiner

[Fig. 1]
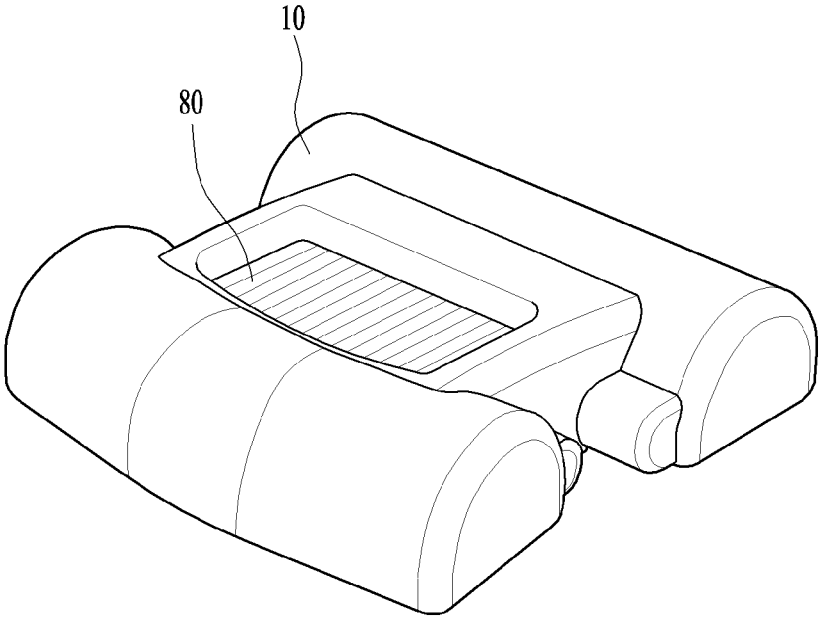
[Fig. 2]
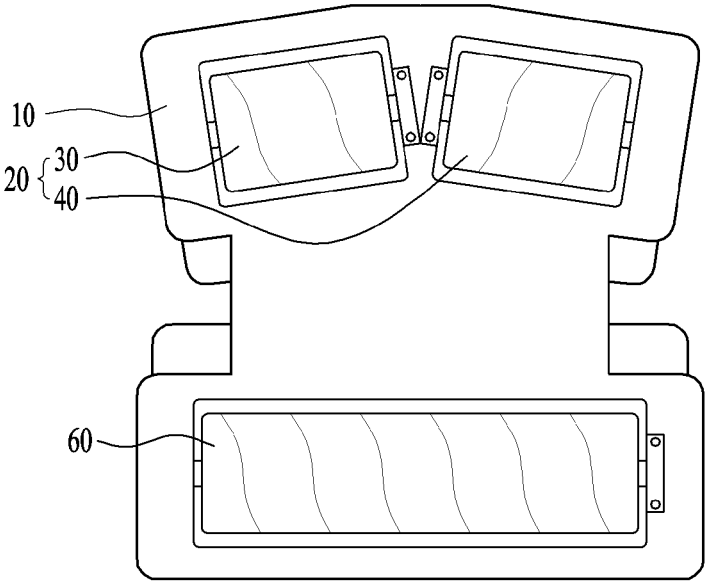

[Fig. 3]
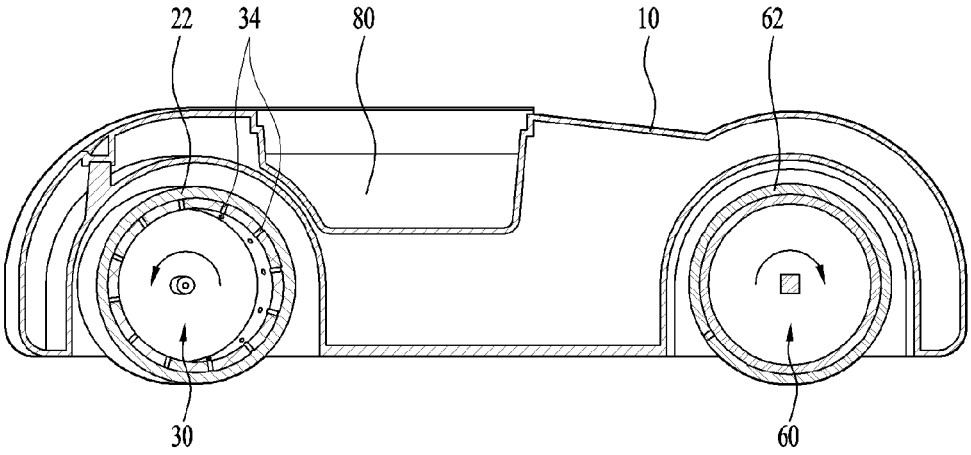
[Fig. 4]
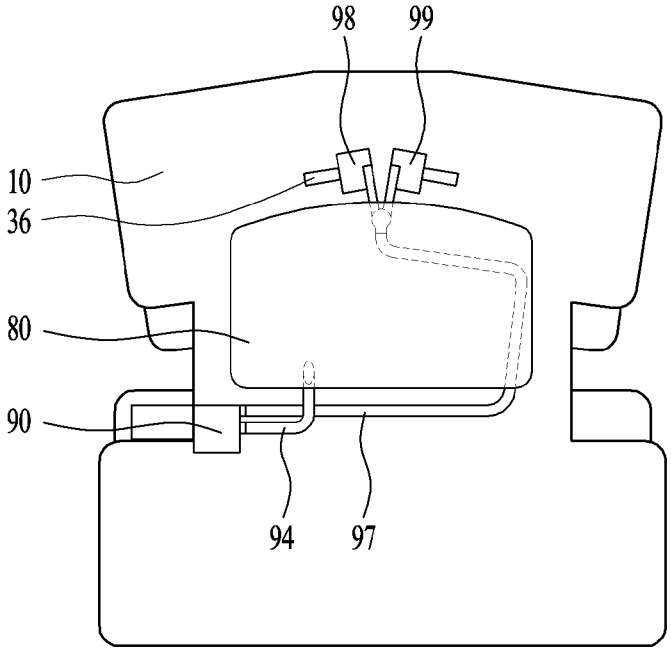

[Fig. 5]
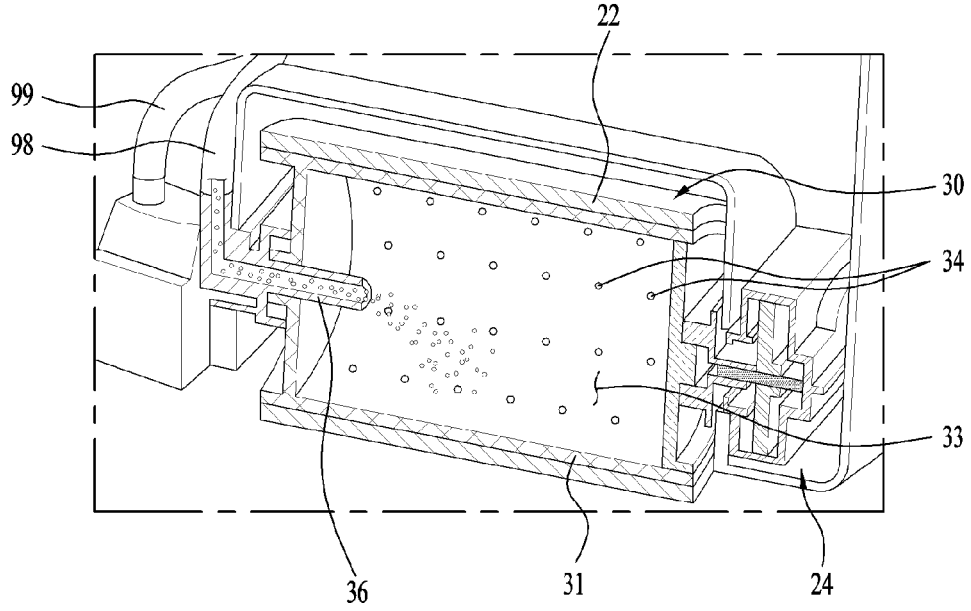
[Fig. 6]
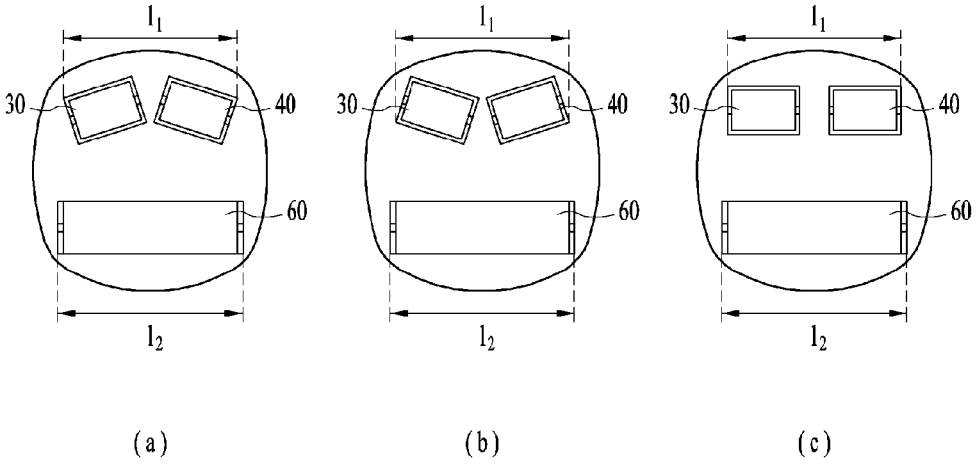
[Fig. 7]
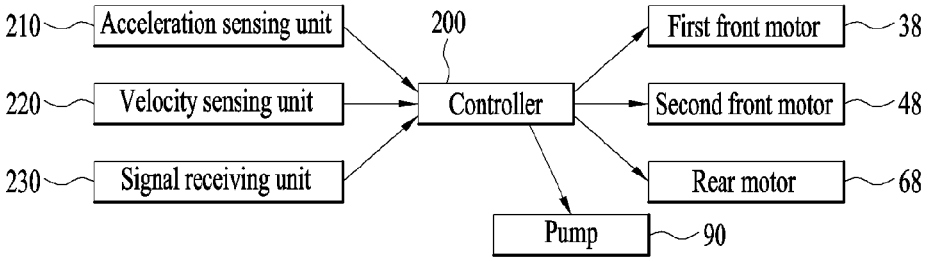

[Fig. 8]
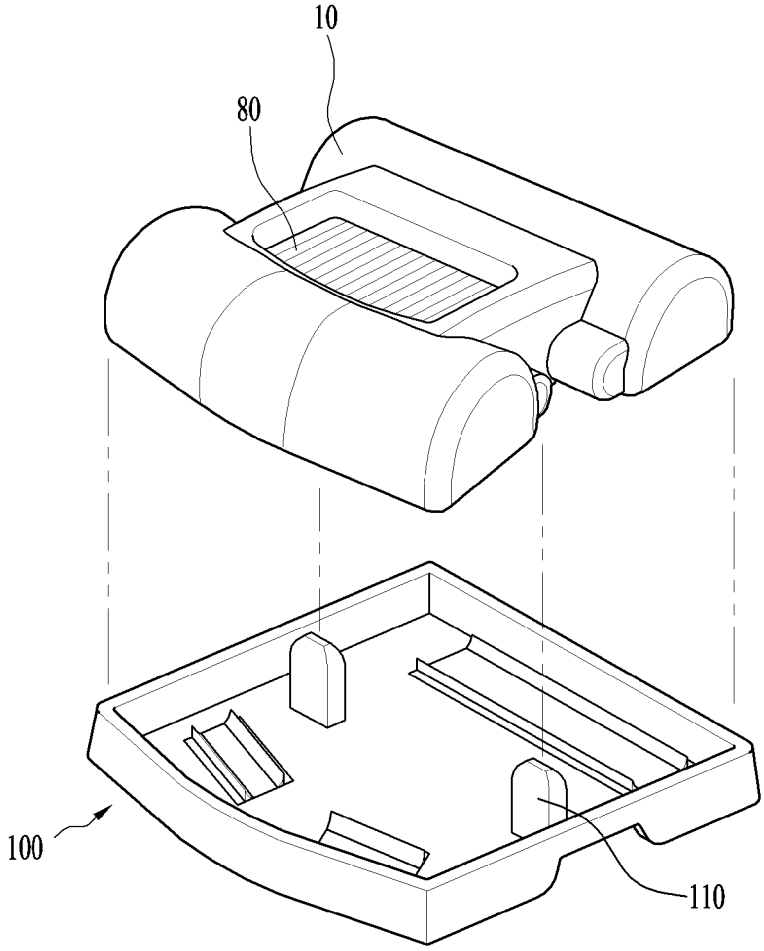
[Fig. 9]
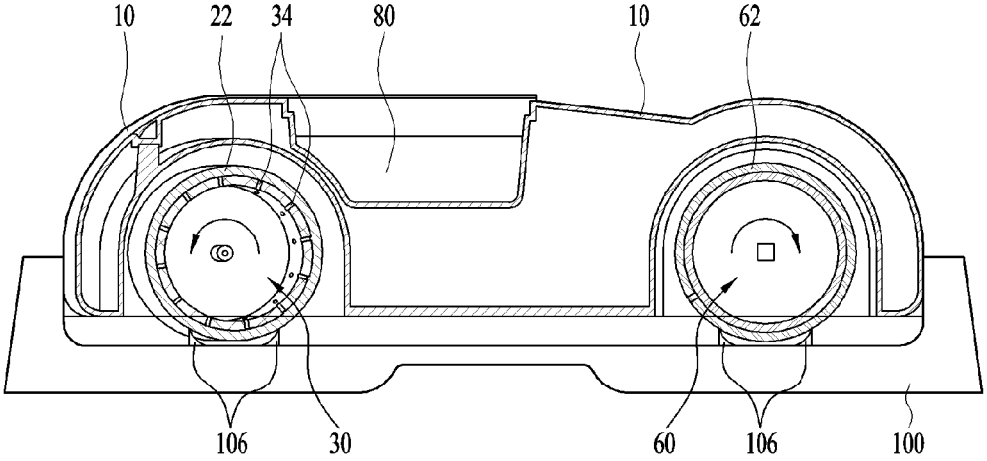

ROBOT CLEANER

CROSS-REFERENCE TO RELATED PATENT APPLICATIONS

This application is a U.S. National Stage Application under 35 U.S.C. § 371 of PCT Application No. PCT/KR2016/010513, filed Sep. 21, 2016, which claims priority to Korean Patent Application No. 10-2015-0134513, filed Sep. 23, 2015, whose entire disclosures are hereby incorporated by reference.

TECHNICAL FIELD

Embodiments of the present disclosure relate to a robot cleaner, more particularly, to a robot cleaner which is capable of cleaning floors, using water.

BACKGROUND ART

A conventional robot cleaner is the mechanism put into operation by a battery power and configured to become automatically mobile according to a command of a microcomputer implemented for controlling a cleaning system based on sensor information and program logic.

In addition, the conventional robot cleaner is usually configured to perform a cleaning function by sucking the dust that is scattered there below on the floor along a route, using fan suction, and move with a mop pad attached to a rear portion thereof so as to remove the fine dust contaminants failed to be sucked and stain on the floor partially and secondarily. The mop pad is usually made of microfibers or fabric.

However, such a conventional robot cleaner cannot inject water to the mop pad. It is difficult to gain the wet-cloth-mopping-like function, if using the conventional robot cleaner having the microfiber or fabric mop pad.

When the conventional robot cleaner moves with pushing the mop pad, a sufficient friction force fails to be applied to the mop pad and then a disadvantage of deteriorated cleaning efficiency might arise.

DISCLOSURE

Technical Problem

Accordingly, the present invention is provided to address the above-noted and other problems. Embodiments of the present disclosure provide a robot cleaner which is capable of cleaning floors, using water.

Embodiments of the present disclosure also provide a robot cleaner which is capable of removing the water used after cleaning from the floor.

Embodiments of the present disclosure also provide a robot cleaner configured to increase frictional force, using water during the cleaning process, so as to improve cleaning efficiency.

Technical Solution

To achieve these objects and other advantages and in accordance with the purpose of the embodiments, as embodied and broadly described herein, roller type or cylinder type mop cloths or brushes are arranged in the bottom surface of the cleaner body. As rolling movement and sliding movement is generated together by the rotation numbers of the mop cloths or brushes and the friction force with the floor, cleaner body moving and sweeping (frictional mopping) for removing floor contaminants are performed at the same time. In other words, the robot cleaner according to the present disclosure has the wheel for moving the cleaner body. The wheel having the function of moving the cleaning body has the function of cleaning the floor as well.

The weight of the robot cleaner is delivered to the wheel and the wheel rotating in contact with the floor increases the friction with the floor. Accordingly, the robot cleaner may have higher cleaning performance in the same operation conditions.

The robot cleaner in accordance with the present disclosure comprises a plurality of front wheels and a rear wheel. The front wheel has a wet-cleaning function using a water supply system and generates the driving force for running in a desired direction. In case of the forward movement, the rear wheel follows and passes the regions where the wet-cleaning is performed. The rear wheel is made of fabric with a high moisture content and good mopping performance and absorbs the water spread by the front wheels.

The rear wheel is rotated in the opposite direction to the rotation direction of the front wheels and balances the power to be located in right place. The front wheels and the rear wheel rotated in the opposite directions are simultaneously in a state of sliding. Also, certain motion for facilitating the running of the cleaner body is generated by the difference of drag forces and the difference of drag forces is generated by the difference between the rotation numbers and friction forces of the front wheels and the rear wheel.

In the robot cleaner of the present disclosure, the water held in the water tank is guided to the front wheels and supplied to the center of the front wheels. At this time, the water is flowing to the front wheels rotated at a high speed and rotating to be injected to an internal surface of the front wheel by the centrifugal force of the front wheel. Hence, the water is exhausted via the outlet holes and reaches an outer surface of the mopping pad/brush fabric so as to keep the inject amount/moisture content for wet-cleaning.

A nozzle may be provided in the rotation axis of the front wheel and keep a stable connection even during the rotation of the front wheel. Also, the water injected from the nozzle may not be concentrated in either of the front wheels and uniformly distributed to the inner surface of the front wheel by the centrifugal force.

The front wheels may change the rotation force provided by the motor into the torque (or the rotation number) for driving which is proper to cleaning or running, using a decelerator.

No water is supplied to the rear wheel and the rear wheel is able to remove the water remaining on the floor after the wet-cleaning of the front wheel. Also, a polishing effect can be expected because of the rotation friction.

The robot cleaner having finished the running for cleaning may perform a function as means for facilitating the washing of the first and second members attached to the outer circumferential surfaces of the front and rear wheels easily. At this time, a blade is provided in an accommodating recess formed in the case to partially accommodate the front and rear wheels and the blade is configured to contact with outer circumferential surfaces of the first and second members.

Once the cleaner body is rested on the case, wash water mixedly dissolved with detergent is held in the accommodating recess and the front wheels and the rear wheel are rotated to become washed.

Once the cleaner body is rested on the case, water with no detergent is held in the accommodating recess and the front wheels and the rear wheel are rotated to become rinsed off.

Once the cleaner body is rested on the case, no water is held to make the accommodating recess become empty and the front wheels and the rear wheel are then rotated to become wrung and dried out.

The front wheels and the rear wheel of the robot cleaner consistently performs rolling movement and sliding movement according to diverse conditions with varying friction force. To control the movement of the cleaner body, the output of the motors may be adjusted and compensated according to the variation of acceleration and velocity and the driving of the motors can be controlled.

Planar motion is determined according to the resultant force of the feeding force generated by toe angle (in/out) and the resultant force generated by the forward and backward movement of the wheels and the torque resultant force from the center of the cleaner body resultant force. The controller may calculate the RPM of the motors based on the acceleration and velocity generated by corresponding variation and control the output of the motors according to the calculated RPM.

The embodiments of the present disclosure may locate the robot cleaner based on a relative distance in a room which is sensed by three or more anchors or beacons implemented to generate a specific radio wave signal (for example, UWB, BLE and etc.) At this time, the controller may operate comparison between the input time of the current location information and the input time of the former location information according to the signal received by the signal receiving unit and calculate velocity information based on the result of the comparison operation. Then, the controller may calculate errors of a remaining distance and location with respect to a target trajectory and a current location based on the location information and estimate a target path by controlling the rotation of the motors.

Embodiments of the present disclosure may provide a robot cleaner comprising a cleaner body; a front wheel rotatably provided in a front portion of the cleaner body; a rear wheel rotatably provided in a rear portion of the cleaner body; a first member attached to an outer circumferential surface of the front wheel and configured to contact with a cleaning object surface; a second member attached to an outer circumferential surface of the rear wheel and configured to contact with the cleaning object surface; a water tank supplying water to the front wheel; and a water supply pipe guiding water to the front wheel from the water.

The front wheel may comprise a hollow cylindrical case; a plurality of outlet holes penetrating the cylindrical case, wherein the hollow is in communication with the supply pipe and water is supplied to the first member via the outlet holes by the centrifugal force generated when the front wheel is rotated. In other words, using the rotation of the front wheel which is a basic function to distribute water to the front wheel, no other additional components have to be provided in the front wheel.

The robot cleaner is typically configured to clean the plane floor when water is supplied to the hollow from the water supply pipe and then collected in a lower portion of the cylindrical case. When the front wheel is rotated in such a state, the water may be uniformly distributed to an inner surface of the front wheel by the centrifugal force and then guided to the first member after passing through the outlet holes.

A nozzle projected to an internal space of the cylindrical case may be provided in the rotation axis of the cylindrical case. The water supply pipe may supply water to the nozzle. The nozzle is projected toward the internal space of the hollow so that water can be supplied to the entire portion of the front wheel along the rotation axis of the front wheel. A pump may be provided in the water supply pipe and the pump may supply water to the front wheel via the water supply pipe.

The front wheel may include a first front wheel and a second front wheel which are provided in both sides of the cleaner body, in symmetry with respect to the center of the cleaner body. The water supply pipe may include an inlet pipe guiding water to the pump from the water tank; and a first outlet pipe and a second outlet pipe branching the water supplied from the pump to the first front wheel and the second front wheel, respectively. The first outlet pipe and the second outlet pipe are provided in the portion where the front wheel and the second wheel face each other, so as to prevent the force from becoming applied to one side of the robot cleaner when water is supplied to the first and second front wheels.

The pump is configured to supply water to the front wheel while the front wheel is rotating to prevent the water from gathering in the lower portion of the front wheel. The first member has a lower moisture content percentage than the second member, so that the water soaked in the first member may soak the cleaner object surface and the second member may absorb the water remaining on the cleaning object surface.

The horizontal width of the front wheel is narrower than that of the rear wheel. The rear wheel may follow the locus of the front wheel running on the cleaning object surface and finish the cleaning. Seen from the top, the front wheel and the water tank may be overlapped with each other.

The front wheel may have the first front wheel and the second front wheel arranged in both sides of the cleaner body in symmetry with respect to the center of the cleaner body. A first front motor may be further provided to drive the first front wheel and a second front motor may be further provided to drive the second front wheel. The first front motor, the second front motor and the rear motor may control the running of the robot cleaner by being driven independently and separately to control the running of the robot cleaner. The first front motor, the second front motor and the rear motor are driven independently and separately and then the cleaning performance of the robot cleaner may be enhanced accordingly.

The first front wheel and the second front wheel may be arranged to face each other, with a forward angle of 180 degrees between a rotation axis of the first front wheel and a rotation axis of the second front wheel. Alternatively, the first front wheel and the second front wheel may be arranged to face each other, with a backward angle of 180 degrees between a rotation axis of the first front wheel and a rotation axis of the second front wheel.

Embodiments of the present disclosure may further include a case where the cleaner body is rested. The case may include a support portion coupled between the upper portion of the wheel and the lower portion of the wheel to support the cleaner body. The user can rest the cleaner body on the case. Wash water is held in the case and the first and second members are soaked by the wash water so that a washing process for the first and second members may be performed.

A blade may be provided in the case to contact with the first member or the second member. When the front wheel and the rear wheel are rotated, foreign substances attached to the first and second members may be removed. A pair of blades may be provided and contact both sides of the first member or second member.

A battery may be further provided in the cleaner body. Seen from the top, the battery may be overlapped with the water tank and the loads of the front and rear wheels may be uniformly distributed.

Embodiments of the present disclosure may provide a cleaner comprising a cleaner body; a front wheel rotatably provided in a front portion of the cleaner body; a rear wheel rotatably provided in a rear portion of the cleaner body; a first member attached to an outer circumferential surface of the front wheel and configured to contact with a cleaning object surface; a second member attached to an outer circumferential surface of the rear wheel and configured to contact with the cleaning object surface; a front motor rotating the front wheel; a rear motor rotating the rear wheel; and a controller driving the front motor and the rear motor, wherein the controller controls the front motor and the rear motor to become rotated in the opposite directions while cleaning is performed. The front motor and the rear motor are rotated in the opposite directions and slip arises in either of the front and rear wheels.

In other words, the running direction of the cleaner body moved by the rotation of the front wheel is different from that of the cleaner body moved by the rotation of the rear wheel. Slip arises in the front or rear wheel and increases the friction force. Accordingly, the force the first and second members apply to the cleaning object surface becomes stronger and the cleaning object surface may be cleaned using a relatively stronger force. Compared with the pushing the cloth attached to the cleaner body and mopping the floor, the robot cleaner may perform enhanced cleaning.

The controller may drive the front motor and the rear motor and controls the rear motor to have a lower rotation number than the front motor. The cleaner body may be moved in the opposite direction to the rotation direction of the rear motor. The rear motor generates slip and facilitates the scrubbing of the first and second members with a stronger force.

The front wheel comprises a first front wheel and a second front wheel provided in both sides of the cleaner body, in a state of becoming in symmetry with respect to the center of the cleaner body. The front motor may comprise a first front motor rotating the first front wheel; and a second front motor rotating the second front wheel. The controller may rotate at least one of the first and second front motors in the opposite direction to the rotation direction of the rear motor.

The rear motor may be rotated at a preset rotation number which is lower than the higher one of the two rotation numbers at which the first front motor and the second front motor are rotated. The rear motor may perform the function of increasing the friction more than the function of running the cleaner body.

The cleaner may further comprise an acceleration sensing unit sensing the acceleration of the cleaner body; a velocity sensing unit sensing the velocity of the cleaner body, wherein the controller compensates the output of the motor based on the information sensed by the acceleration sensing unit and the velocity sensing unit.

The cleaner may further comprise a signal receiving unit receiving the radio wave transmitted from an external device, wherein the controller locates the cleaner body based on the signal received by the signal receiving unit. The signal receiving unit may receive the radio wave transmitted from the transmission units arranged different locations.

The front wheel and the rear wheels are rotated in the opposite directions and slip arises. Accordingly, errors cannot help occurring if determining the location or movement of the cleaner body, using the torque or rotation direction of the front or rear wheel. In other words, even when the torque is measured by using the encoder installed in the motor, the slip of the wheel cannot be recognized. Accordingly, it is preferred to determining the location or moving direction of the robot cleaner, using external transmission units not the conventional encoder.

Advantageous Effects

The embodiments have following advantageous effects. The robot cleaner performs wet-cleaning, using water, and the foreign substances stuck to the floor may be mopped and removed.

Furthermore, the robot cleaner may increase the friction force with the floor and the cleanness of the wet-cleaning may be enhanced. In other words, the wet member is attached to the rotary wheel and the wheel is rotated. Accordingly, the member for wet-cleaning not just passing the floor may create the effect of hand-mopping and scrubbing Still further, the water tank holding water may be overlapped with the member for mopping the floor and the load of the water tank is applied to the member to increase the friction force when performing wet-cleaning. Accordingly, the performance of the wet-cleaning may be enhanced.

After performing wet-cleaning for the floor, the moisture or water remaining on the floor may be removed and water stains may be prevented. After the soaked member performs the wet-cleaning, the dry member performs cleaning for the floor and performs double-cleaning for the same floor or cleaning object surface.

Using the centrifugal force generated by the rotation of the wheel, water may be uniformly distributed to the member for the wet-cleaning for the floor and the moisture content percentage of the wet member may be adjusted properly. The robot cleaner may acquire accurate information for the location of the cleaner body by using external signal for locating the cleaner body. The robot cleaner may remove the foreign substances attached thereto, using water.

DESCRIPTION OF DRAWINGS

FIG. 1 is a perspective diagram illustrating one embodiment of the present disclosure;

FIG. 2 is a diagram illustrating a low area of FIG. 1;

FIG. 3 is a side sectional diagram of FIG. 1;

FIG. 4 is a diagram illustrating key parts of FIG. 1;

FIG. 5 is a diagram illustrating a front wheel;

FIG. 6 is a conceptual diagram of diverse examples of the present disclosure;

FIG. 7 is a control block diagram illustrating the embodiment of the present disclosure;

FIGS. 8 and 9 are diagrams illustrating a case in which the embodiment of the present disclosure is seated stably.

BEST MODE

Figure 10:
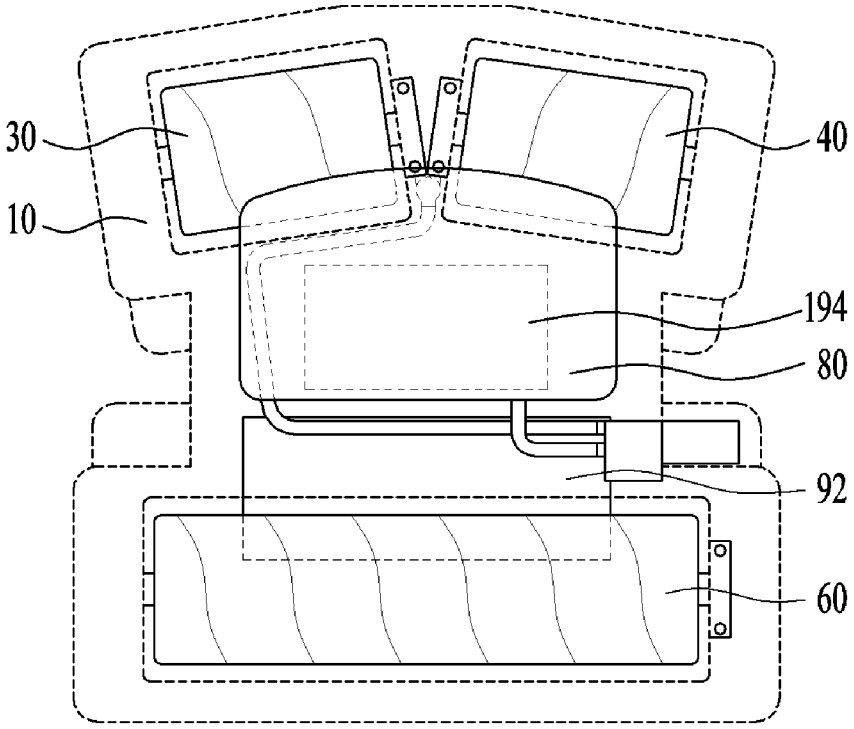
FIG. 10 is a diagram illustrating another embodiment of the present disclosure.

Referring to the accompanying drawings, exemplary embodiments of the present disclosure according to one embodiment of the present disclosure will be described in detail. Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that the embodiments presented herein are not limited by the accompanying drawings.

FIG. 1 is a perspective diagram illustrating one embodiment of the present disclosure and FIG. 2 is a diagram illustrating a low area of FIG. 1. FIG. 3 is a side sectional diagram of FIG. 1 and FIG. 4 is a diagram illustrating key parts of FIG. 1. FIG. 5 is a diagram illustrating a front wheel.

Referring to FIGS. 1 through 5, a robot cleaner in accordance with one embodiment of the present disclosure includes a cleaner body 10 defining an exterior design thereof; a front wheel 20 rotatably provided in a front portion of the cleaner body 10; a rear wheel 60 rotatably provided in a rear portion of the cleaner body 10; a first member (or first wheel cover) 22 attached to an outer circumferential surface of the front wheel 20 to contact with a cleaning object surface; a second member (or second wheel cover) 62 attached to an outer circumferential surface of the rear wheel 60 to contact with a cleaning object surface; and a water tank 80 for supplying water to the front wheel 20.

The first member 22 and the second member 62 are configured to separate dust and foreign substances from the cleaning object surface (for example, the floor) while contacting with the cleaning object surface.

The first member 22 and the second member 62 are rotated together with the front wheel 20 and the rear wheel 60, respectively, while contacting with the cleaning object surface. Compared with the cleaning degree of the conventional robot cleaner sweeping the floor along the movement of the cleaner body 10, the robot cleaner is able to apply a higher friction force to the cleaning object surface and have an enhanced cleaning efficiency.

As shown in FIG. 1, the water tank 80 may be provided near the center of the cleaner body 10 or arranged a little bit closer to the front wheel 20 with respect to the center of the cleaner body 10.

As shown in FIG. 2, the front wheel 20 includes a first front wheel 30 and a second front wheel 40 which are symmetrically arranged in both sides with respect to the center of the cleaner body 10. In other words, the front wheel 20 is configured of two wheels, not one wheel. The first front wheel 30 and the second front wheel 40 are arranged facing each other.

The rear wheel 60 as one wheel may be arranged behind the front wheel 20. In case the front wheel 20 includes the first front wheel 30 and the second front wheel 40, the first member 22 is not arranged between the first front wheel 30 and the second front wheel 40 so that there can be a certain space not cleaned by the first member 22. However, the rear wheel 60 is configured as one wheel and the second member 62 contacts with all of the area where the rear wheel 60 rotatably passes, to perform cleaning for the cleaning object surface.

Referring to FIG. 4, the illustrated embodiment may include a water supply pipe for guiding water to the front wheel 20 from the water tank 80 to the front wheel 20. A pump 90 is provided in the water supply pipe to generate the pressure moving the water held in the water tank 80 to the front wheel 20.

The water supply pipe includes an inlet pipe 94 for guiding water from the water tank 80 to the pump 90; a transmission pipe 97 transmitting the water from the pump 90 to the branched portion to the first front wheel 30 and the second front wheel 40; and a first outlet pipe 98 and a second outlet pipe 99 branched to the first front wheel 30 and the second front wheel 40.

The water flowing from the water tank 80 is guided to the pump 90 along the inlet pipe 94 and flows to the transmission pipe 97 after passing the pump 90. Hence, the water is branched to the first outlet pipe 98 and the second outlet pipe 99 from the transmission pipe 97 and then dividedly supplied to the first front wheel 30 and the second front wheel 40.

The first outlet pipe 98 and the second outlet pipe 99 are symmetrically arranged with respect to the center of the cleaner body 10 so as to stop the force which might be applied to one side of the cleaner body 10 by the flux of the water flowing to the first front wheel 30 and the second front wheel 40. Accordingly, the noise or vibration generated by the flow of water may be prevented and driving stability may be then secured.

The first outlet pipe 98 and the second outlet pipe 99 are provided in the portion where the first front wheel 30 faces the second front wheel 40 correspondingly, so that they can guide the water to the first front wheel 30 and the second front wheel 40, respectively. Looking down at the cleaner body 10, the front wheel 20 and the water tank 80 are overlapped with each other. As holding water, the water tank 80 is the component having a relatively more load than the other components of the robot cleaner. When the water tank 80 is overlapped with the front wheel 20, the load of the water tank 80 could be largely concentrated on the front wheel 20 and the friction force of the front wheel 20 might be increased. The friction force of the first member 22 with respect to the cleaning object surface is increased and cleaning efficiency is able to be enhanced, when the wet first member 22 in contact with the cleaning object surface performs cleaning.

The front wheel 20 includes a hollow cylindrical case 31; and a plurality of outlet holes 34 penetrating the cylindrical case 31. The hollowness 33 is in communication with the water supply pipe so that water is supplied to the first member 22 via the outlet holes 34 once the front wheel 20 starts to rotate.

A nozzle 36 may be further provided in the rotational axis of the cylindrical case 31 and projected inside the cylindrical case 31. The water supply pipe is configured to supply water to the nozzle 36 and a corresponding number of nozzles 36 are provided in the first front wheel 30 and the second front wheel 40, respectively. The nozzles 36 are connected to the first outlet pipe 98 and the second outlet pipe 99 to guide water to the first front wheel 30 and the second front wheel 40. The first front wheel 30 and the second front wheel 40 are formed in the same structure and located in different positions in symmetry.

Meanwhile, the pump 90 is put into operation to supply water to the front wheel 20, while the front wheel 20 is rotating. When the front wheel 20 starts to rotate, a centrifugal force is generated in the front wheel 20 and the water is uniformly distributed in the front wheel 20. A gear box 24 may be provided in the opposite portion of the nozzle 36 in the first front wheel 30 and transmit the rotational force generated by the motor to the first front wheel 30. As shown in FIG. 5, the nozzle 36 is arranged in the left portion of the first front wheel 30 and the gear box 24 is arranged in the right portion of the first front wheel 30. In this instance, both the nozzle 36 and the gear box 24 are connected to the shaft of the first front wheel 30.

The gear box 24 changes the rotation number or force generated in the motor and transmits the changed rotation number or force to the first front wheel 30.

The outlet holes 34 provided in the cylindrical case 31 are uniformly distributed in the cylindrical case 31. When the water injected from the nozzle 36 is uniformly distributed to the cylindrical case 31, the outlet holes 34 provide the paths for supplying the water to the first member 22.

The first member 22 is supplied the water having passed the outlet holes 34 and performs cleaning in contact with the cleaning object surface, with the water. The outlet holes 34 are formed in the cylindrical case 31 in plural lines and the lines are arranged at preset intervals.

The first member 22 has a lower percentage of water content than the second member 62. The first member 22 is provided with water and performs cleaning for the cleaning object surface, in a state of containing water. The second member 62 is able to remove the water remaining on the cleaning object surface while moving over the region where the first member 22 has just passed. In other words, the second member 62 includes the material capable of absorbing the water used by the first member from the cleaning object surface and leaving no water stains on the cleaning object surface.

Specifically, the first member 22 may be made of a certain material having a relatively large porosity, for example, washing sponge and the second member 62 may be made of a certain material having a relatively small porosity, for example, micro-fiber. The first member 22 and the second member 62 have different porosities. Even the front wheel 20 and the rear wheel 60 are rotating at the same rotation numbers, the friction force the front wheel 20 applies can be different from the friction force the rear wheel 60 applies to the same cleaning object surface. In case the first member 22 and the second member 62 clean the same region, diverse friction forces may provide cleaning diversity and then cleaning efficiency may be enhanced.

FIG. 6 is a conceptual diagram of diverse examples of the present disclosure.

As one example of the present disclosure shown in FIG. 6*a*, the first front wheel 30 and the second front wheel 40 may be arranged to face each other, with an angle of 180 degrees between a rotation axis of the first front wheel 30 and a rotation axis of the second front wheel 40 forward.

In this instance, the horizontal width (I1)) of the front wheel 20 including the first front wheel 30 and the second front wheel 40 is smaller than the horizontal width (I2) of the rear wheel 60, so that the rear wheel 60 can pass the region the front wheel has passed.

As the front wheel performs cleaning, using the wet first member 22, it is quite probable that water remains on the cleaning object surface cleaned by the first member 22. The second member 62 absorbs the remaining water and finishes the cleaning.

As another example of the present disclosure shown in FIG. 6*b*, the first front wheel 30 and the second front wheel 40 face each other, with an angle of 190 or less between the rotation axis of the first front wheel 30 and the axis of the second front wheel 40 backward. Even in this instance, the horizontal width (I1) of the front wheel 20 including the first front wheel 30 and the second front wheel 40 is smaller than the horizontal width (I2) of the rear wheel 60. When the front wheel 30 and the second front wheel 40 are inclined with respect to the front surface as shown in FIGS. 6*a* and 6*b*, the driving of the robot cleaner to change a direction of the cleaner body 10 can be facilitated.

As a further example of the present disclosure shown in FIG. 6*c*, the rotation axis of the first front wheel 30 and the rotation axis of the second front wheel 40 are arranged on the same extended line. The horizontal width (I1) of the front wheel 20 including the first front wheel 30 and the second front wheel 40 is smaller than the horizontal width (I2) of the rear wheel 60. The rotating drive of the robot cleaner shown in FIG. 6*c* is performed by differentiating the rotational number of the first front wheel 30 from that of the second front wheel 40.

FIG. 7 is a control block diagram illustrating the embodiment of the present disclosure. Referring to FIG. 7, the embodiment of the present disclosure includes a front motor 38 driving the first front wheel 30; a second front motor 48 driving the second front wheel 40; and a rear motor 68 driving the rear wheel 60.

In other words, the two front wheels 20 and the one rear wheel 60 are driven by different motors, respectively, so that the two front wheels 20 and the one rear wheel 60 are different from each other and controlled independently. The illustrated embodiment may include a controller 200 for controlling the first front motor 38, the second front motor 48 and the rear motor 68.

The illustrated embodiment may further include an acceleration sensing unit (or acceleration sensor) 210 sensing acceleration of the cleaner body 10 and a velocity sensing unit (or velocity sensor) 220 sensing the velocity of the cleaner body 10. The controller 200 is able to control the motors by compensating the output of the motor based on the information sensed by the acceleration sensing unit 210 and the velocity sensing unit 220.

The illustrated embodiment may further include a signal receiving unit (or signal receiver) 230 receiving an electromagnetic wave which is transmitted from an external device. The controller 200 may locate the cleaner body 10 based on the signal received by the signal receiving unit 230. At this time, an external beacon is capable of transmitting a radio wave which is receivable by the signal receiving unit 230.

A plurality of signal oriented devices are provided in different places so that the signal receiving unit 230 can receive the radio wave transmitted from transmitters of the signal oriented devices arranged in the different places. The signal receiving unit 230 compares the strengths and directions of the received signals from the transmitters and the times when the signals are received with each other and also the information received in the former location with the information received in the current location, so that it can FIG. out the location or direction based on the result of comparison.

The controller 200 controls the front motor and the rear motor 68 to be rotated in the opposite directions while the cleaning is performed. In case the front motor includes the first front motor 38 and the second front motor 48, the controller may control one or more of the first and second front motors 38 and 48 to be rotated in the opposite direction of the direction in which the rear motor 68 is rotated.

When the front motor and the rear motor are rotated in the opposite directions, for example, when the front motor is rotated in the counter-clockwise direction and the rear motor 68 in the clockwise direction, viewed in FIG. 3, the front wheel 20 is rotated in the counterclockwise direction and the rear wheel 60 is rotated in the clockwise direction.

The two wheels installed in the different positions of one cleaner body 10 are rotated in the opposite directions and slip occurs in one or more wheels. Such slip occurs even when providing the force applied against the driving direction of the cleaner body 10 not in a state where the wheels stand still only to increase the friction force the robot cleaner applies to the cleaning object surface. Accordingly, the friction forces the first member 22 and the second member 62 apply to the cleaning object surface are increased and the robot cleaner is capable of cleaning the cleaning object surface, with a stronger force, only to improve the cleaning performance.

The controller 200 may control the cleaner body 10 not to be moved even when the front and rear wheels 20 and 60 are rotated in the opposite directions, by adjusting the rotation numbers of the front and rear motors. In this instance, deep cleaning can be performed for the current region in contact with the first member 22 and the second member 62 of the cleaner body 10.

As mentioned above, slip occurs in the wheels of the illustrated embodiment. In case of using encoder for sensing the rotation number of the motor, large errors cannot help arising in sensing the location and direction of the robot cleaner. Accordingly, the illustrated embodiment includes a transmission unit (or transmission) for generating a signal is provided outside the robot cleaner and the signal receiving unit receives a signal from the external transmission unit only to locate the robot cleaner based on the received signal.

It is possible that the rotation number of the motor is controlled and compensated by using the encoder. The encoder cannot provide reliable information which can be used in determining the location of the robot cleaner.

The front wheel 20 includes two wheels and the rear wheel 60 includes one wheel, so that the robot cleaner can be moved by the front wheel 20. In this instance, the controller 200 may drive the front motor and the rear motor 68 to make the rotation of the rear motor 68 lower than that of the front motor.

If the rotation number of the front motor is higher than that of the rear motor 68, the force applied to the front wheel 20 becomes stronger enough for the front wheel 20 to move the cleaner body dominantly. The rear motor 68 performs the function of generating slip. If the rotation number of the rear motor is higher, the degree of slip becomes larger. If the rotation number of the rear motor is lower, the degree of slip becomes smaller. Accordingly, the cleaner body 10 may be moved in the opposite direction to the rotation direction of the rear motor.

FIGS. 8 and 9 are diagrams illustrating a case in which the embodiment of the present disclosure is seated stably. Referring to FIGS. 8 and 9, the robot cleaner may further include a case on which the cleaner body 10 is seated. The case 100 includes a support unit (or support pillar) 110 connected between the front wheel 20 and the rear wheel 60 to support the cleaner body 10.

The case 100 is placed under the cleaner body 10 and the cleaner body 10 is rested on the case 100. The support unit 110 is arranged higher than a bottom surface of the case 100 and insertedly fitted between the front wheel 20 and the rear wheel 60 to be connected to the cleaner body 10. Wash water is held in the case 100 and the first member 22 and the second member 62 are well moistened.

Moreover, a blade 106 may be provided in the case 100 to contact with the first member 22 or the second member 62. The blade 106 may be provided in both sides of the first member 22 and both sides of the second member 62, to contact with the first and second members 22 and 66 when the first member 22 and the second member 62 are rotated. When the first and second members 22 and 62 starts to rotate, the blade 106 contacts with the first and second members 22 and 62 and the foreign substances attached to the first and second members 22 and 62 are then separated.

In a state where the cleaner body 10 is rested on the case 100, wash water may be held in the case 100 and the front wheel 20 and the rear wheel 60 becomes rotated with the wash water held in the case 100. Then, the wash water is absorbed to the front wheel 20 and the rear wheel 60 and friction is generated against the blade 106 so that the first member 22 and the second member 62 can be washed (a washing process).

In a state where the cleaner body 10 is rested on the case 100, water with no detergent may be held in the case 100. When the front and rear wheels 20 and 60 are rotated, the water held in the case becomes absorbed to the front and rear wheels 20 and 60 and friction is generated against the blade 106 so that the first member 22 and the second member 62 can be rinsed off (a rinsing process).

In addition to the washing and rinsing processes, nothing is held in the case 100 (an empty state) while the cleaner body 10 is rested on the case 100. When the front and rear wheels 20 and 60 are rotated in the empty state, the water contained in the first and second members 22 and 62 may be separated by the centrifugal force. In other words, while the cleaner body 10 is rested on the case 100, the first and second members 22 and 62 can be wrung out (a wring-drying process).

FIG. 10 is a diagram illustrating another embodiment of the present disclosure. Referring to FIG. 10, the first front wheel 30 and the second front wheel 40 are arranged in an upper portion within the cleaner body 10. The water tank 80 is partially overlapped with the first and second front wheels 30 and 40.

A battery 194 is provided and the electricity supplied from an external power supply source is deposited in the battery 194 and then supplied to the motor. The battery 194 may be arranged overlapped with the water tank 80. A circuit board 92 is mounted under the water tank 80 and the rear wheel 60 is arranged under the circuit board 92.

The battery 194 and the water tank 80 are quite heavy in the robot cleaner, compared with the other components. Because of that, the battery 194 and the water tank 80 are arranged near the center of the cleaner body 10 in a state of getting overlapped with each other so as not to concentrate the load of the battery 194 on either of the front and rear wheels 20 and 60. Accordingly, the friction of the front and rear wheels 20 and 60 can be uniformly increased and the force applied to the first and second members 22 and 62 to contact with the floor can be uniformly increased.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

The invention claimed is:

1. A robot cleaner comprising:

a cleaner body;

at least one rotatable front wheel provided in a front portion of the cleaner body;

at least one rotatable rear wheel provided in a rear portion of the cleaner body;

a rear motor driving the at least one rotatable rear wheel;

a first wheel cover attached to an outer circumferential surface of the at least one rotatable front wheel and configured to contact a surface to be cleaned;

a second wheel cover attached to an outer circumferential surface of the at least one rotatable rear wheel and configured to contact the surface to be cleaned;

a water tank that supplies water to the at least one rotatable front wheel; and a water supply pipe that guides the water from the water tank to the at least one rotatable front wheel, wherein the at least one rotatable front wheel includes, a hollow cylindrical case having a plurality of outlet holes;

a first front wheel provided at a first side of the cleaner body, and a second front wheel provided at a second side of the cleaner body, the first front wheel and the second front wheel being positioned in symmetry with respect to a center of the cleaner body;

a first motor driving the first front wheel; and a second motor driving the second front wheel, wherein when the at least one rotatable front wheel is rotated, a centrifugal force allows water to flow to the first wheel cover via the plurality of outlet holes.

2. The robot cleaner of claim 1, further including a nozzle projected from a rotation axis of the at least one rotatable front wheel and toward an inside of the cylindrical case, wherein the water supply pipe supplies water to the nozzle.

3. The robot cleaner of claim 1, wherein a pump is provided in the water supply pipe, and the pump is operated to supply the water held in the water tank to the at least one rotatable front wheel via the water supply pipe.

4. The robot cleaner of claim 3, wherein the water supply pipe includes:

an inlet pipe to guide the water from the water tank to the pump; and first and second outlet pipes to branch the water from the pump to the first front wheel and the second front wheel, respectively, and the first outlet pipe and the second outlet pipe are provided between the first front wheel and the second front wheel.

5. The robot cleaner of claim 3, wherein the pump is operated to supply the water to the at least one rotatable front wheel while the at least one rotatable front wheel is rotated.

6. The robot cleaner of claim 1, wherein a water content percentage of the first wheel cover is lower than a water content percentage of the second wheel cover.

7. The robot cleaner of claim 1, wherein a horizontal width of the at least one rotatable front wheel is smaller than that of the at least one rotatable rear wheel.

8. The robot cleaner of claim 1, wherein the water tank is overlapped with the at least one rotatable front wheel when viewed from above.

9. The robot cleaner of claim 1, wherein a rotation axis of the first front wheel and a rotation axis of the second front wheel are offset by an angle of 180° or less.

10. The robot cleaner of claim 1, wherein a rotation axis of the first front wheel and a rotation axis of the second front wheel are offset by an angle of 180° or more.

11. The robot cleaner of claim 1, further including a case on which the cleaner body is rested, wherein the case includes a support pillar provided between the at least one rotatable front wheel and the at least one rotatable rear wheel and supporting the cleaner body.

12. The robot cleaner of claim 11, wherein wash water is held in the case and the first wheel cover and the second wheel cover are soaked in the wash water.

13. The robot cleaner of claim 11, wherein a blade is provided in the case and configured to contact the first wheel cover or the second wheel cover.

14. The robot cleaner of claim 13, wherein a pair of blades are provided in the case and configured to contact two regions of the first wheel cover or the second wheel cover.

15. The robot cleaner of claim 1, further including a battery provided in the cleaner body, wherein the battery is overlapped with the water tank, when viewed from above.

* * * * *